US008551373B2

(12) United States Patent
Ina

(10) Patent No.: US 8,551,373 B2
(45) Date of Patent: Oct. 8, 2013

(54) PROCESS FOR PRODUCING RECLAIMED CASTING SAND

(75) Inventor: Yoshimitsu Ina, Aichi (JP)

(73) Assignee: Kao Corporation, Tokyo (JP)

( * ) Notice: Subject to any disclaimer, the term of this patent is extended or adjusted under 35 U.S.C. 154(b) by 443 days.

(21) Appl. No.: 12/676,804

(22) PCT Filed: Sep. 11, 2008

(86) PCT No.: PCT/JP2008/066897
§ 371 (c)(1),
(2), (4) Date: Mar. 5, 2010

(87) PCT Pub. No.: WO2009/035134
PCT Pub. Date: Mar. 19, 2009

(65) Prior Publication Data

US 2010/0252951 A1 Oct. 7, 2010

(30) Foreign Application Priority Data

Sep. 12, 2007 (JP) ..... 2007-236707
Feb. 13, 2008 (JO) ..... 2008-31503

(51) Int. Cl.
*B02C 1/00* (2006.01)

(52) U.S. Cl.
USPC ..... 264/37.29; 264/219; 264/314; 241/15

(58) Field of Classification Search
USPC ..... 264/219
See application file for complete search history.

(56) References Cited

U.S. PATENT DOCUMENTS

| | | | | | |
|---|---|---|---|---|---|
| 5,089,540 | A * | 2/1992 | Armbruster et al. | ..... | 523/213 |
| 5,169,880 | A * | 12/1992 | Yoshida et al. | ..... | 523/145 |
| 5,816,312 | A * | 10/1998 | Suginaka et al. | ..... | 164/456 |
| 6,286,580 | B1 | 9/2001 | Ward et al. | | |
| 2007/0173550 | A1 | 7/2007 | Busby | | |
| 2010/0173767 | A1 * | 7/2010 | Koch et al. | ..... | 501/128 |

FOREIGN PATENT DOCUMENTS

| | | | | |
|---|---|---|---|---|
| CN | 1174171 | A | 2/1998 | |
| EP | 1595617 | A1 | 11/2005 | |
| JP | 61-63333 | A | 4/1986 | |
| JP | 4-13438 | A | 1/1992 | |
| JP | 6-154941 | A | 6/1994 | |
| JP | 10-59711 | A | 3/1998 | |
| JP | 2001-504040 | A | 3/2001 | |
| JP | 2003-251434 | A | 9/2003 | |
| JP | 2004-202577 | A | 7/2004 | |
| JP | 2005-177759 | A | 7/2005 | |
| JP | 2005-193267 | A | 7/2005 | |
| WO | WO 2005/107975 | A1 | 11/2005 | |
| WO | WO 2008/101668 | * | 8/2008 | ..... 264/319 |

OTHER PUBLICATIONS

Chemical Book, Silicon Oil, 2010, http://www.chemicalbook.com/ChemicalProductProperty_EN_CB1330649.htm.*

(Continued)

*Primary Examiner* — Benjamin Schiffman
(74) *Attorney, Agent, or Firm* — Birch, Stewart, Kolasch & Birch, LLP

(57) ABSTRACT

The present invention relates to a process for producing reclaimed casting sand, which has step (I) of grinding recovered sand in the presence of an additive (A) containing a liquid having a surface tension of not higher than 35 mN/m at 25° C. and a boiling point of not lower than 150° C. at 1 atmospheric pressure.

8 Claims, 3 Drawing Sheets

(56) References Cited

OTHER PUBLICATIONS

Matsunaga et al., Measurements of gas/oil free surface deformation caused by parallel gas flow, Physics of Fluids, vol. 24, Issue 6, Jun. 11, 2012, Table 1.*
Igata Chuzo Hou (Mold Casting Process), 4th Edition, Nov. 18, 1996, Japan Association of Casting Technology, pp. 327-330.
Zukai Chuzo Yougo Jiten (Illustrated Dictionary of Casting Terms) edited by Japanese Foundry Engineering Society and published on Apr. 28, 2003 by Nikkan Kogyo Shimbun, Ltd.
Chinese Office Action dated May 18, 2011 for Application No. 200880106756.7.
Chinese Office Action of Chinese Application No. 200880106756.7 dated Mar. 12, 2012 with English translation.
Notice of Ground of Rejection for corresponding Japanese Patent Application No. 2008-231954, dated Feb. 19, 2013.
Notification of the 3rd Office Action for corresponding Chinese Patent Application No. 200880106756.7, dated Dec. 5, 2012.
Chinese Office Action dated Apr. 16, 2013 for Chinese Application No. 200880106756.7 with English translation.

* cited by examiner

PROCESS FOR PRODUCING RECLAIMED CASTING SAND

FIELD OF THE INVENTION

The present invention relates to a process for producing reclaimed casting sand from recovered sand recovered from a mold.

BACKGROUND OF THE INVENTION

Casting sand used in a mold is reutilized sometimes by milling the mold (mold disassembly) into sand and then reclaiming the recovered sand. As the process for reclaiming recovered sand, various processes such as a wet reclaiming process, a heating reclaiming process and a dry reclaiming process have been proposed for a long time (for example, "Igata Chuzo Hou" (Mold Casting Process), 4th edition, Nov. 18, 1996, Japan Association of Casting Technology, pp. 327-330) and practically used. JP-A6-154941 discloses a process for reclaiming casting sand, which contains subjecting heat treatment to predetermined recovered sand and then subjecting the sand to dry grinding treatment.

JP-A2005-177759 discloses a dry reclaiming process which contains adding fine grains to casting sand and then reclaiming the sand.

SUMMARY OF THE INVENTION

The present invention relates to a process for producing reclaimed casting sand, which includes step (I) of grinding recovered sand in the presence of an additive (A) containing a liquid having a surface tension of not higher than 35 mN/m at 25° C. and a boiling point of not lower than 150° C. at 1 atmospheric pressure (referred to hereinafter as additive (A)).

The present invention also relates to a process for producing a mold, which contains using reclaimed casting sand obtained by the production process of the present invention.

DETAILED DESCRIPTION OF THE INVENTION

Figure 1:
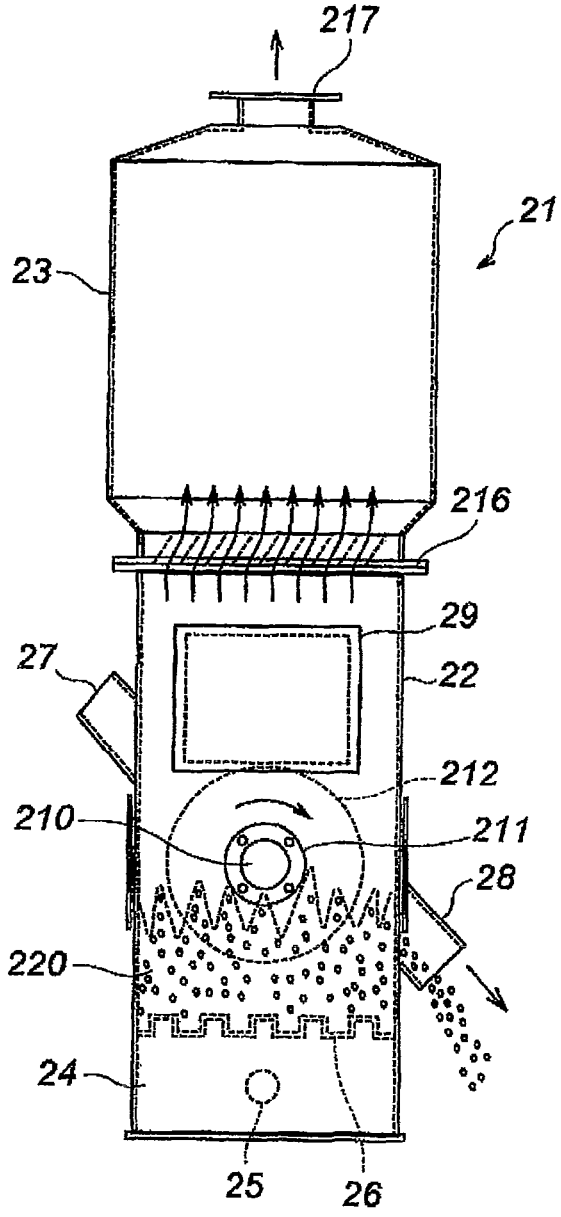
FIG. 1 is a schematic cross-section showing one example of a casting sand-reclaiming apparatus that can be used in dry grinding treatment of recovered sand in the presence of additive (A)

In conventional arts, the wet reclaiming process requires a wastewater treatment equipment and thus necessitates the cost of equipment and increases the reclamation cost. Further, sand should be dried after reclamation treatment. The heating reclaiming process requires combustion facilities and air-cooling facilities and thus necessitates tremendous energy costs, and exhaust gas treatment should be performed. In the dry reclaiming process, a method of utilizing centrifugal force to give friction among sand particles thereby removing a binder etc. adhering to the surfaces of the sand particles is prevailing at present. In this method, however, when the efficiency of reclamation is to be increased, the yield is reduced due to destruction and pulverization of sand, and power source unit per tone of recovered sand is also increased.

For improving the yield of reclamation by preventing destruction of sand, that is, for reducing wastes, artificial ceramic sand with high resistance to fracture has been developed and practically used, however for increasing the efficiency of reclamation by removing only a binder strongly adhering to the surfaces of sand particles, reclaiming apparatuses should be arranged in series, so there is a problem of further necessity for power source unit.

Under this background, JP-A 2005-177759 discloses a dry reclaiming process which contains reclamation after addition of fine grains to casting sand. However, a step of removing the fine grains is necessary, thus complicating the process. When removal of the fine grains is insufficient, the strength of a mold may be decreased.

Under this background, a proposal for a process for producing reclaimed casting sand efficiently by an easy method without using tremendous facilities has been expected for reclamation of casting sand.

The present invention provides a process for producing reclaimed casting sand, which can improve casting qualities and mold strength with a high degree of removal of impurities.

According to the process for producing reclaimed casting sand, casting sand from which residual organic components were efficiently removed can be obtained. The casting sand reclaimed by the present invention can provide a mold excellent in mold strength.

The surface tension is determined by Wilhelmy method in the invention Specifically, it can be measured by an automatic surface tensiometer using Wilhelmy method.

The recovered sand used in the present invention is described as reclaimed sand in "Zukai Chuzo Yougo Jiten" (Illustrated Dictionary of Casting Terms) edited by Japanese Foundry Engineering Society and published on Apr. 28, 2003 by Nikkan Kogyo Shimbun, Ltd.

Specifically, the recovered sand used in the present invention is recovered sand and surplus sand (both of which are hereinafter referred to collectively as recovered sand) obtained by milling a mold (mold disassembly) produced using a binder in casting sand such as silica sand, zircon sand, chromite sand, synthetic mullite sand, $SiO_2/Al_2O_3$-based casting sand, $SiO_2/MgO$-based casting sand, or slag-derived casting sand.

When the recovered sand used in the present invention is to be subjected to reclamation treatment, the sand may contain not only recovered sand but also new sand. The effect of the present invention can be obtained depending on the amount of recovered sand. Particularly, when the recovered sand is contained in an amount of 50% by weight or more, a sufficient effect can be obtained.

In the present invention, from the viewpoint of increasing the degree of removal of residual resin and of decreasing wastes, the recovered sand is preferably recovered sand derived from artificial ceramic sand such as synthetic mullite sand, $SiO_2/Al_2O_3$-based casting sand, $SiO_2/MgO$-based casting sand, or slag-derived casting sand.

The artificial ceramic sand does not include naturally occurring casting sand such as silica sand, zircon sand or chromite sand, but casting sand obtained by artificially regulating metal oxide components in sand and then melting or sintering the sand. From the viewpoint of high resistance to fracture and further reduction in wastes, casting sand containing not less than 80 wt % $Al_2O_3$ and $SiO_2$ in total at an $Al_2O_3/SiO_2$ weight ratio of 1 to 15 is preferable. The artificial ceramic sand preferably has a crystal phase of at least one of mullite, α-alumina and γ-alumina.

From the viewpoint of exhibiting a further effect, the present invention shows a significant effect on recovered sand derived from spherical casting sand. The sphericity of the spherical casting sand from which the recovered sand is derived is preferably 0.88 or more, more preferably 0.92 or more, even more preferably 0.95 or more, even more preferably 0.99 or more.

The sphericity can be determined by image analysis of an image (photograph) of the particle obtained by an optical microscope or a digital scope (for example, VH-8000 manufactured by Keyence Corporation), thereby determining the area of a projected section of the particle and the circumference of the section, and then calculating (circumference (mm) of a circle having the same area as the area ($mm^2$) of the projected section of the particle)/(circumference (mm) of the projected section of the particle), wherein arbitrary 50 spherical casting sand particles are measured to determine their average as sphericity.

The spherical casting sand is advantageous in that the filling rate thereof upon formation into a mold is high and the strength of the mold is high, however in dry machine reclamation, the friction among grains of sand is so low that the efficiency of reclamation is not good. However, efficient reclamation is made feasible with the advantages of spherical casting sand according to the present invention.

Such spherical casting sand can be produced for example by a method of granulating refractory raw slurry by spray drying to make it spherical followed by sintering, a method of melting a refractory raw material and jetting the material out with air from nozzles to make it spherical, or a method of dispersing refractory particles in a carrier gas and melting the particles in flame to make them spherical; for example, the spherical casting sand can be produced by methods shown in JP-A 61-63333, JP-A 2003-251434, JP-A 2005-193267, and JP-A 2004-202577.

Recovered sand derived from the artificial ceramic sand and/or the spherical casting sand is contained preferably in an amount of 50% by weight or more in the recovered sand in the present invention.

In the recovered sand in the present invention, the binder is preferably an organic binder from the viewpoint of the effect of the present invention, that is, efficient removal of residual organic components in the recovered sand. Examples of the organic binder include an alkali phenol resin, furan resin, thermosetting phenol resin (shell mold), and urethane resin.

In the recovered sand from a mold wherein artificial ceramic sand is used as the casting sand and hardened with an alkali binder as the binder, the sand is rigid and residual organic components are softer than the sand and adhere strongly thereto, thus making reclamation of the sand difficult, however the present invention also exhibits a sufficient effect on such recovered sand.

The alkali phenol resin includes phenol resins obtained for example by reacting a phenol such as phenol, cresol, resorcinol, bisphenol A or another substituted phenol as a starting material with an aldehyde compound in the presence of an alkali catalyst. The alkali catalyst includes alkali metal hydroxides such as lithium hydroxide, sodium hydroxide and potassium hydroxide, alkaline earth metal hydroxides such as calcium hydroxide, magnesium hydroxide and beryllium hydroxide, amine compounds, and mixture thereof. Generally, the number of moles of the alkali catalyst is 0.05- to 4-fold, more preferably 0.1- to 3-fold, based on the number of moles of the phenol.

The organic ester includes γ-butyrolactone, propionolactone, ε-caprolactone, ethyl formate, ethylene glycol diacetate, ethylene glycol monoacetate, triacetin, and ethyl acetoacetate.

The production process of the present invention contains step (I) of grinding recovered sand in the presence of an additive (A).

The additive (A) is a liquid having a surface tension of not higher than 35 mN/m at 25° C. and a boiling point of not lower than 150° C. at 1 atmospheric pressure.

The technical significance in definition of the additive (A) as a liquid having a surface tension of not higher than 35 mN/m at 25° C. is that dust generated upon grinding treatment is allowed to hardly adhere to reclaimed sand. The technical significance in definition of the additive (A) as a liquid having a boiling point of not lower than 150° C.; at 1 atmospheric pressure is that the additive (A) is prevented from disappearing more rapidly than dust during dust collection.

The surface tension of the additive (A) at 25° C. is preferably 15 to 35 mN/m, more preferably 15 to 33 mN/m, from the viewpoint of preventing dust, generating upon the grinding treatment, from adhering on reclaimed sand. Further, the boiling point of the additive (A) at 1 atmospheric pressure is preferably 150 to 400° C., more preferably 165° C. to 400° C., from the viewpoint that they may not be lost more quickly than dust in collection of dust. The additive (A) contains a material having a decomposition point of 400° C. or less and being liquid at least at 150° C.

The additive (A) is preferably at least one member selected from a silicone oil, an alcohol having 8 to 18 carbon atoms, a carboxylic acid having 8 to 18 carbon atoms, an alkyl silicate having an alkyl group having 1 to 8 carbon atoms and lower condensates thereof, and a polyoxyalkylene alkyl ether having an alkyl group having 8 to 18 carbon atoms.

Examples of the silicone oil that can be used in the present invention include dimethyl silicone oil, methyl hydrogen silicone oil, methyl phenyl silicone oil, cyclic dimethyl silicone oil, amino-modified silicone oil, polyether-modified silicone oil, alkyl-modified silicone oil, and alcohol-modified silicone oil. The silicone oil is preferably dimethyl silicone oil.

The surface tension (25° C.) of the silicone oil is preferably 15 to 25 mN/m, more preferably 15 to 22 mN/m. The viscosity (25° C.) of the silicone oil is preferably 5 to 300 $mm^2/s$, more preferably 5 to 50 $mm^2/s$. The ignition point of the silicone oil is preferably higher from the viewpoint of safety and is preferably 100° C. or more, more preferably 150° C. or more, even more preferably 200° C. or more.

As the alcohol having 8 to 18 carbon atoms used in the present invention, a linear aliphatic alcohol, a branched aliphatic alcohol, an unsaturated aliphatic alcohol or the like is used, and its surface tension (25° C.) is preferably 15 to 33 mN/m. The viscosity (25° C.) of the aliphatic and aromatic alcohols is preferably 2 to 100 $mm^2/s$, more preferably 2 to 50 $mm^2/s$. The alcohol is preferably oleyl alcohol or octanol.

As the carboxylic acid having 8 to 18 carbon atoms used in the present invention, a linear aliphatic carboxylic acid, a branched aliphatic carboxylic acid, an unsaturated aliphatic carboxylic acid or the like is used. The surface tension (25° C.) of the organic carboxylic acid is preferably 15 to 35 mN/m. The viscosity (25° C.) of the carboxylic acid is preferably 2 to 100 $mm^2/s$, more preferably 2 to 50 $mm^2/s$.

The alkyl silicate having an alkyl group having 1 to 8 carbon atoms used in the present invention includes methyl silicate, ethyl silicate etc., and lower condensates thereof. The degree of condensation of the lower condensates is preferably 1 to 15. The alkyl silicate is preferably ethyl silicate or its lower condensate.

In the polyoxyalkylene alkyl ether having an alkyl group having 8 to 18 carbon atoms used in the present invention, the average number of oxyalkylene groups added per molecule is preferably 0.5 to 10, more preferably 1 to 5, even more preferably 1 to 3. Preferable examples of the oxyalkylene group include oxyethylene group, an oxypropylene group and an oxybutylene group having 2 to 4 carbon atoms.

The ignition point of the additive (A) is preferably higher from the viewpoint of safety and is preferably 100° C. or more, more preferably 150° C. or more, even more preferably 200° C. or more.

The amount of the additive (A) per 100 parts by weight of recovered sand during the grinding treatment is preferably 0.001 part by weight or more from the viewpoint of exhibiting an effect of removing residual resin or 0.2 part by weight or less from an economic viewpoint and the viewpoint of saturation of the effect, and thus the additive (A) is allowed to be present in a ratio of preferably 0.001 to 0.2 part by weight, more preferably 0.005 to 0.1 part by weight, even more preferably 0.01 to 0.05 part by weight, relative to 100 parts by weight of recovered sand.

In the present invention, the grinding treatment of recovered sand is conducted preferably plural times, wherein the grinding treatment is conducted at least once in the presence of the additive (A), preferably in the presence of a silicone oil. That is, the production process of the present invention is a process wherein the grinding treatment of recovered sand is conducted at least once, and the grinding treatment is conducted at least once in the presence of the additive (A), preferably in the presence of a silicone oil. When grinding is conducted plural times, first grinding may be conducted by adding the additive (A), preferably a silicone oil, to recovered sand prior to a step of removing residual organic components from recovered sand by grinding treatment (including grinding treatment with water described later), however from the viewpoint of the effect of separating and removing impurities, it is preferable that the grinding treatment is conducted after addition of the additive (A), preferably a silicone oil, to recovered sand at the time of grinding treatment. The added amount in the grinding treatment is preferably 0.001 part by weight or more to 100 parts by weight of reclaimed sand from the viewpoint of removing residual resin. Then the added amount is preferably 0.2 part by weight or less from an economic viewpoint and from the viewpoint of saturation of the effect. That is, the added amount is preferably 0.001 to 0.2 part by weight, more preferably 0.005 to 0.1 part by weight, even more preferably 0.01 to 0.05 part by weight. In this case, the term "at the time of grinding treatment" refers to time between a point just before the grinding and during grinding. It is more preferable that sand after subjected once or more to grinding treatment is subjected to grinding treatment by adding the additive (A), preferably a silicone oil, to the sand.

The method of adding the additive (A) to recovered sand or to recovered sand after grinding treatment may be either a continuous or batch method. A method of spraying the additive (A) or a method of adding the additive (A) quantitatively through nozzles may be used. The additive and recovered sand may be mixed in a special mixing machine, however because they are mixed in a reclaiming machine, use of a special mixing machine is not particularly necessary. Alternatively, a reclaiming machine in which grinding treatment is conducted in the presence of the additive (A) may be provided with an adding means such as a spray and nozzles through which the additive (A) is added. Depending on the case, the addition time can be controlled with a sequence or the like to regulate the addition time appropriately.

According to the process for producing reclaimed casting sand in the present invention, it is possible to obtain casting sand from which residual organic components were removed more efficiently than by the conventional method of mechanically treating the surface of sand. Casting sand reclaimed by the present invention can provide a mold excellent in mold strength.

The reason for the particular improvement in mold strength as the effect of the present invention is not evident, and it is estimated that by the presence of the additive (A), adhering components removed from reclaimed sand by grinding treatment are prevented from adhering again to the surface of the sand, resulting in such a significant difference in mold strength.

In the present invention, the grinding treatment of recovered sand is conducted by friction among casting sand grains and by friction among the sand and members (a rotor, an internal wall, and a whetstone) in the reclaiming apparatus.

The grinding treatment in step (I) can be conducted in accordance with grinding treatment in the conventional method of reclaiming casting sand, preferably in the dry process. Such methods include, for example, methods with a jetting stream type apparatus (a method of removing adhering materials by blowing off sand grains with high-speed air thereby giving impact and friction to the sand grain), a vertical axis rotation type and horizontal axis rotation type apparatus (a method of removing adhering materials by blowing off or stirring sand grains with a body of rotation or blades or by pressurization with a rotor, thereby giving impact and friction to the sand grains), and a vibration type apparatus (a method of removing adhering materials, mainly with a frictional action by vibration force giving a stirring action to sand grains).

Preferably, the grinding treatment in the presence of the additive (A) is carried out simultaneously with removal of releasable components particularly releasable organic components from sand. That is, the removal of releasable organic components (discharge of releasable organic components from the grinding system) is preferably conducted in step (I) of grinding treatment of recovered sand in the presence of the additive (A). Releasable organic components allowed to hardly adhere to sand by the present invention can be efficiently removed from the surface of the sand and can simultaneously be separated and removed from sand by dust collection. The removal of releasable organic components can be conducted using an apparatus provided with a means of dust collection. Such an apparatus includes Hybrid Sand Master manufactured by Nippon Chuzo Co., Ltd. and Sand Fresher manufactured by Casting Machine Kiyota, and these apparatuses are more preferably used.

The process of the present invention preferably contains both step (Ia) where the grinding treatment of recovered sand is conducted once or more and step (Ib) where the sand after step (Ia) is subjected to grinding treatment by adding the additive (A) and simultaneously releasable organic components are removed. Step (Ia) is grinding treatment in substantially the absence of the additive (A) and can be carried out with the jetting stream type apparatus, the vertical axis rotation type apparatus, the horizontal axis rotation type apparatus or the vibration type apparatus. Specifically, step (Ib) is carried out for example as shown in JP-A 7-80594 wherein recovered sand subjected once or more to grinding treatment in step (Ia), and the additive (A), are introduced into a casting sand-reclaiming apparatus provided with a fluidized bed having, in its lower surface, many openings through which air is jetted out, and while the recovered sand is fluidized and stirred with the jetted air, a horizontal-axis rotor is rotated to cause impact and friction among sand grains as well as impact and friction between the sand grains and the rotor, thereby effecting grinding treatment. This can be carried out using the apparatus shown in FIG. 1 described later.

The grinding treatment in step (Ib) is a dry grinding treatment. This can be carried out by a known method to recovered sand to which the additive (A) have been added after the grinding treatment of step (Ia). A fluidized bed-type dry grinding apparatus, provided with a rotating member for grinding inside of the fluidized tank, is preferably used to remove effectively residual organic components being easily removable by the grinding treatment of step (Ia). One example of this treatment is described by reference to the drawings.

FIG. 1 is a schematic cross-section of a casting sand-reclaiming apparatus that can be used in dry grinding treatment in step (Ib) in the present invention, wherein 21 is the body of equipment. The body 21 is angular and is formed into a two-stage structure composed of 2 lower and upper parts that are a lower stirring tank 22 and an upper classification tank 23. 24 is a blast room formed at the bottom of the stirring tank 22, 25 is a blast opening, and 26 is a fluidized bed. The fluidized bed 26 is provided with a large number of convex protrusions having a plurality of vent holes formed in the side thereof. 27 and 28 are an inlet tube and a discharge tube respectively, which are arranged in the wall at opposed positions of the stirring tank 22, and 29 is a see-through window. Both the inlet tube 27 and outlet tube 28 are arranged aslant in the wall at opposed positions of the stirring tank 22, and although not showing in detail, the openings of the inlet and outlet tubes, which are arranged on the same plane as that of the side wall, can be adjustably opened and closed by manual operation. 210 is a drive axis, 211 is left and right bearings, and 212 is a rotor. The bearings 211 are attached to the wall at both side of the stirring tank 22 and maintain the drive axis 210 in halfway height in the horizontal direction. 216 is a regulation plate, 217 is an exhaust opening, and 220 is recovered sand to which the additive (A) was added after grinding treatment in step (Ia).

In the apparatus in FIG. 1, the sand to which the additive (A) was added after grinding in step (Ia) is introduced through the inlet tube 27. Air from a blower is blown from the blast opening 25 through the fluidized bed 26 into the stirring tank 22, to fluidize the sand. The fluidized sand is ground both against the rotor 212 driven by a driving source, arranged in the stirring tank 22, and having a rough surface inclined toward the rotating face and against sand accumulated by centrifugal force in the vicinity of the swaying plate, thereby releasing materials adhering to the sand. The released adhering materials (released organic components etc.) are separated from the sand in a classification tank 23 provided with dust collection openings which communicate, via the regulation plate 216, with the upper part of the stirring tank 22. After treatment for a predetermined time, the reclaimed casting sand is discharged through the outlet tube 28 (discharge opening).

In the present invention, it is preferable that after 0.5 to 20 parts by weight of water are added to 100 parts by weight of recovered sand, grinding treatment (hereinafter referred to grinding treatment with water) is conducted. The difference between this grinding treatment with water and the conventional wet reclaiming process is that in the wet reclaiming process, recovered sand is reclaimed in a slurry state, that is, in a state of sand filled with water in voids in a particle layer thereof, while in the grinding treatment with water, recovered sand in a state ranging from a funicular region to capillary region, that is, a state of sand with water occurring in voids in a particle layer thereof but not occurring as a complete continuous layer. When the amount of water herein is 0.5 part by weight or more relative to 100 parts by weight of recovered sand, residual organic components in the recovered sand can be easily and efficiently removed. When the amount of water is 20 parts by weight or less relative to 100 parts by weight of recovered sand, a sewage-treatment apparatus or excessive drying can be easily made unnecessary. This process uses a small amount of water and thus does not necessitate tremendous drying facilities and sewage-treatment apparatus as in the wet reclaiming process, and can give stronger load to sand than by the grinding treatment of sand in a slurry state. Further, this process, as compared with the process of mechanically treating the surface of sand, can easily produce casting sand from which residual organic components were efficiently removed. It is estimated that by adding a small amount of water to recovered sand during grinding treatment, residual resin components strongly adhering to the sand is made easily removable, and by step (I) of grinding treatment in the presence of the additive (A), the residual organic components once removed can be prevented from adhering again to the surface of the sand, and as a result, the residual organic components in the recovered sand can be efficiently removed.

In the present invention, the grinding treatment with water (grinding treatment in the presence of a predetermined amount of water) may be conducted at any stage in the process for producing reclaimed casting sand. When the grinding treatment of recovered sand is conducted plural times, the grinding treatment with water may be conducted at least once. That is, in the production process of the present invention, the grinding treatment of recovered sand may be conducted in the presence of a predetermined amount of water. For example, the grinding treatment with water may be conducted simultaneously with step (I); that is, grinding treatment in the presence of the additive (A) may be conducted by adding water. Alternatively, the process of the present invention may be provided with the grinding treatment with water, separately from step (I), that is, separately from grinding treatment in the presence of the additive (A), and when the process has the steps (Ia) and (Ib) as described above, the grinding treatment with water may be conducted in either of the steps. Preferably, the grinding treatment with water is conducted in step (Ia), and then step (Ib), that is, the grinding treatment in the presence of the additive (A) is conducted (preferably in substantially the absence of water). When the step of grinding treatment with water is arranged separately different from step (I) or conducted in step (Ia), the grinding treatment is conducted preferably in substantially the absence of the additive (A).

The process in the present invention may contain both the step of grinding treatment with water and step (I) of dry grinding treatment in the presence of the additive (A) (grinding treatment in substantially the absence of water). That is, after the grinding treatment of recovered sand is conducted by adding 0.5 to 20 parts by weight of water to 100 parts by weight of the recovered sand, the dry grinding treatment can be conducted in the presence of the additive (A). When step (I) is provided with the steps (Ia) and (Ib) as described above, step (Ia) of grinding treatment with water added in an amount of 0.5 to 20 parts by weight to 100 parts by weight of recovered sand can be carried out as step (I). Accordingly, the method and apparatus for the grinding treatment with water described later are preferably those adapted to carry out step (Ia). A part of step (Ia) can be carried out as grinding treatment with water, and the order in this case is not limited.

The step of grinding treatment with water may be conducted either by introducing recovered sand to which water was added, into the grinding apparatus, or by introducing recovered sand into the grinding apparatus and simultaneously sprinkling water by spraying or the like. From the viewpoint of easily fluidizing the sand to which water was added, the grinding treatment with water in the present invention is carried out preferably by the grinding method using an apparatus of vertical axis rotation type, horizontal axis rotation type or vibration type, more preferably by the grinding method using an apparatus of vertical axis rotation type.

Specifically, recovered sand to which water was added is fed by dropping to a high-speed rotation drum having an opening on the upper part thereof, or recovered sand is fed by dropping to a high-speed rotation drum having an opening on the upper part thereof and water is also added thereto, and then the recovered sand is subjected to grinding processing by friction, impact and intrusion among sand grains by rotation of the rotation drum, and simultaneously the recovered sand to which water was added is scattered by centrifugal force and simultaneously retained on a circular body arranged on the upper circumference and thereby subjected to similar grinding processing, and further the recovered sand to which water was added is fluidized in a space formed between the rotation drum and the circular body. By such fluidizing grinding processing, the recovered sand can be reclaimed. This is conducted preferably with the apparatus shown in FIG. 2 described later.

From the viewpoint of giving more effective frictional treatment, the number of rotations of the high-speed rotation drum is preferably 1000 rpm or more to 3000 rpm or less, more preferably 2000 to 2800 rpm. By rotating the drum at a high speed, highly efficient reclaiming treatment is feasible in a short time, and the facilities can be downsized.

From the viewpoint of efficiently removing residual organic components from recovered sand and of making a sewage-treatment apparatus or excessive drying unnecessary, the amount of water in the grinding treatment with water is 0.5 to 20 parts by weight, preferably 0.5 to 10 parts by weight, more preferably 1 to 5 parts by weight, relative to 100 parts by weight of recovered sand.

Step (I) of grinding treatment in the presence of the additive (A) in the present invention can be carried out for example by subjecting recovered sand to the grinding treatment as described above. In the present invention, step (I) is conducted preferably in substantially the absence of water. With the term "in substantially the absence of water" it is meant that the amount of water in sand to be subjected to the dry grinding treatment is preferably 0.2% by weight or less, more preferably 0.1% by weight or less, from the viewpoint of efficient removal of residual resin components in the dry grinding treatment. Accordingly, when the process contains the grinding treatment with water, the sand in which the amount of water was reduced preferably to this range is used in step (I).

The amount of water in sand can be determined by a method of measuring the amount of water in sand in JACT Test Method S-9.

The step in which recovered sand after the grinding treatment with water is subjected to dry grinding treatment in the presence of the additive (A) can be carried out by a method in which the recovered sand after the grinding treatment with water is dried under fluidization and stirring and simultaneously subjected to the grinding treatment, however from the viewpoint of efficiently removing residual organic components from the recovered sand, it is preferable that after the step of drying the recovered sand that was subjected to the grinding treatment with water, the dried recovered sand is subjected to grinding treatment. When the dried recovered sand is to be subjected to grinding treatment, the recovered sand in a moistened state after the grinding treatment with water is compounded with the additive (A), dried and subjected to dry grinding treatment. Alternatively, the recovered sand can be subjected to the grinding treatment with water, then dried, compounded with the additive (A) and subjected to dry grinding treatment.

The step of drying the recovered sand after the grinding treatment with water can be carried out for example by drying the recovered sand after the grinding treatment with water, in a known drying device such as a rotary kiln or a fluidized bed, or through natural drying by placing the recovered sand in a place where it is easily dried. For promoting drying, the recovered sand may be exposed to hot air or the like as an auxiliary means.

Hereinafter, the process for producing reclaimed casting sand according to the present invention, which contains the step of grinding treatment with water and the subsequent step (I) of dry treatment, is described by reference to the drawings.

Figure 2:
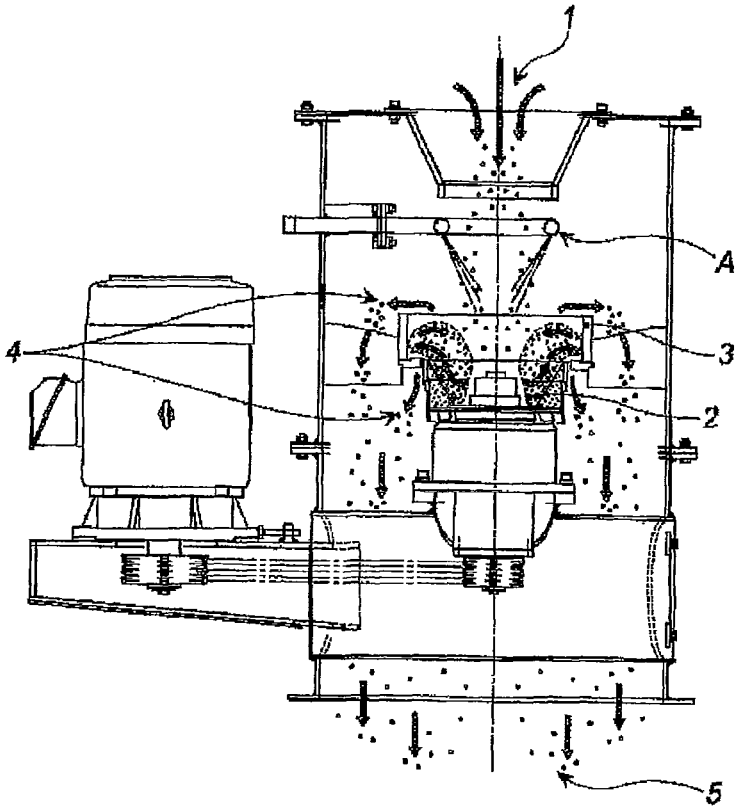
FIG. 2 is a schematic cross-section showing one example of a casting sand-reclaiming apparatus that can be used in grinding treatment with water in the present invention.

FIG. 2 shows one example of an apparatus suitable for the grinding treatment with water in the present invention, which is a vertical axis rotation type grinding apparatus. The apparatus in FIG. 2 is a vertical axis rotation type apparatus including a rotation drum provided with an opening through which recovered sand is received, a circular body arranged close to the circumference in the upper part of the rotation drum and receiving recovered sand scattered by centrifugal force from the rotation drum, and a means of adding water to recovered sand received by the rotation drum, wherein by rotation of the rotation drum, the recovered sand is subjected to grinding treatment by friction, impact and intrusion among sand grains in the space formed between the rotation drum and the circular body. In FIG. 1, 1 is an opening for introduction of recovered sand, 2 is a high-rotation drum provided with an opening for receiving recovered sand, 3 is a circular body, 4 is recovered sand that was subjected to the grinding treatment with water, 5 is an opening for discharging recovered sand, and A is a means (e.g. a nozzle) of adding water to introduced recovered sand. The treatment in the apparatus in FIG. 2 is briefly as follows: Recovered sand obtained by treating a cast mold with a crusher is introduced through the upper opening 1. A predetermined amount of water is added via A to the introduced recovered sand. The sand to which water was added in such a suitable amount as not to fill voids among sand grains with water is kept in a state of moistened sand without forming slurry and retained in the space between the upper part of the high-speed rotation drum 2 and the circular body 3, and the sand to which water was added is pushed against the circular body 3 by the centrifugal force of the high-speed rotation drum 2 that is rotating at high speed, during which the sand grains are ground not only against one another but also against 3. In the structure of the apparatus, a stiffening plate or the like is designed such that the sand to which a predetermined amount of water was added can be retained and simultaneously discharged from the gap in a predetermined retention time. The sand thus treated is discharged from a reclaimed-sand discharge opening 5 and subsequently subjected to drying and dry grinding treatment. The treated sand is discharged in a moistened state and thus does not generate discharged water, unlike the conventional wet reclamation, and does not generate dust either in this process.

Figure 3:
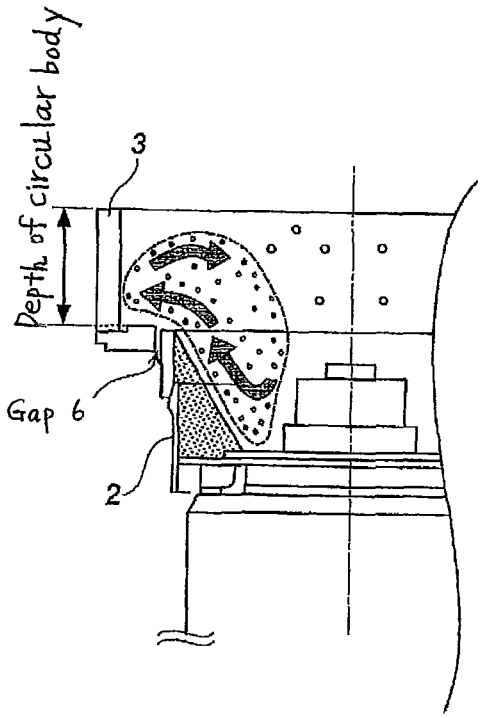
FIG. 3 is an enlarged schematic cross-section showing a part of a casting sand-reclaiming apparatus that can be used in grinding treatment with water in the present invention.

When the grinding treatment with water is conducted in a certain time, the effect of reclamation treatment is generally increased. From the viewpoint of attaining an excellent reclamation effect, it is preferable that in the apparatus in FIG. 2 for example, the time in which the recovered sand 4 is retained in the space between the rotation drum 2 and the circular body 3 and subjected to grinding treatment, that is, retention time from when the recovered sand is retained till when the sand is discharged, is appropriately determined. In the apparatus in FIG. 2, the retention time can be regulated depending on the length of the gap formed between the upper circumference of the rotation drum and the circular body, the depth of the circular body, and the rate of introduction of recovered sand. From this viewpoint, the upper circumference of the rotation drum 2 and the circular body 3 in the vertical axis rotation type apparatus form the gap 6 having a length that is 5- to 50-times, particularly 10- to 25-times the average particle size of the recovered sand 4 (FIG. 3), and specifically the length of the gap is preferably 1 to 15 mm, more preferably 1.5 to 6 mm, even more preferably 1.5 to 4 mm. Generally, the average particle size of the recovered sand is about 75 to 600 μm. This average particle size of the recovered sand is obtained as a particle size (median size) at which mass standard cumulative fraction reaches 0.5, according to a method described in the expression (Z 8819-1) of particle-size measurement result in JIS, on the basis of the result of particle-size distribution of recovered sand grains measured according to the test method (Z 2601) for particle-size distribution of casting sand in JIS. The rate of introduction of recovered sand is preferably 1 to 10 t/hr, more preferably 1.5 to 5 t/hr. When these conditions are used, the number of rotations of the rotation drum is preferably in the range as described above.

For increasing the efficiency of grinding treatment in the grinding treatment with water, the position for introducing recovered sand or water is preferably regulated. In the vertical axis rotation type grinding apparatus, water or water and recovered sand are introduced preferably toward the center of the rotation drum 2 in the vertical axis rotation type grinding apparatus, that is, in the vicinity of the rotation axis. The region "in the vicinity of the rotation axis", though varying depending on the size of the rotation drum, is preferably between the rotation axis and a position apart by (rotation drum diameter/4) from the axis, more preferably between the rotation axis and a position apart by (rotation drum diameter/5) from the axis.

The method described herein can be grasped as a method wherein step (Ia) is conducted by grinding treatment with water, and subsequently step (Ib) is conducted in the presence of the additive (A), and the recovered sand after the grinding treatment with water can be subjected to grinding treatment in the method of step (Ib) to give reclaimed casting sand.

The reclaimed casting sand obtained by the process of the present invention is used in production of a mold. The process for producing a mold is not particularly limited as long as the reclaimed casting sand obtained by the process of the present invention is used to produce a mold. This process is specifically a process for producing a mold which has hardening the reclaimed sand with an organic binder. The organic binder includes an alkali phenol resin, furan resin, thermosetting phenol resin (shell mold), and urethane resin, and a mold can be produced using the organic binder in its corresponding hardening method known in the art. Preferably, the organic binders are added in an amount of usually 0.05 to 10 parts by weight based on 100 parts by weight of the reclaimed sand. The conventionally known silane coupling, additives etc. may also be used. The process for producing a mold according to the present invention is applied preferably to a mold obtained by hardening the binder with an organic ester compound.

EXAMPLES

The present invention is described in more detail by reference to the Examples below. The Examples are merely illustrative of the present invention and not intended to limit the present invention.

Example 1

0.30 part by weight of a hardening agent for alkali phenol resin (Kao Step KC-130 manufactured by Kao-Quaker Co., Ltd.) and 1.2 parts by weight of an alkali phenol resin (Kao Step S-660 manufactured by Kao-Quaker Co., Ltd.) were added to 100 parts by weight of spherical artificial ceramic casting sand with a sphericity of 0.99 containing 94 wt % $Al_2O_3$ and $SiO_2$ in total at an $Al_2O_3/SiO_2$ ratio (weight ratio) of 1.9 (the balance: $TiO_2$, 2.9% by weight; $Fe_2O_3$, 1.3% by weight; and very small amounts of CaO, MgO, $Na_2O$ and $K_2O$). The mixture was stirred and formed into a mold having a sand/metal ratio of 4. A cast iron melt (FC200) at 1400° C. was poured into this mold and then cooled, and the mold was treated with a crusher to give recovered sand. The average particle size of the recovered sand was 200 μm. 0.1 part by weight of dimethyl silicone oil (KF96-10CS manufactured by Shin-Etsu Chemical Co. Ltd.) was added to, and mixed with, 100 parts of the recovered sand which was then subjected 4 times to dry grinding treatment with a rotating drum at a rotation number of 2450 rpm, at a sand feed rate of 3.1 t/hr, in a general vertical axis rotation type grinding apparatus (Rotary Reclaimer M, manufactured by Nippon Chuzo Co., Ltd.) to give reclaimed sand (the dimethyl silicone oil was added only once in the first grinding treatment). Analytical values of the recovered sand and reclaimed sand and results of a casting strength test are shown in Table 1. LOI, the degree of removal of LOI, and mold strength were evaluated by the following methods.

(1) LOI and the Degree of Removal of LOI Removal

The loss of ignition (LOI) in casting sand was measured according to JACT Test Method S-2, and the degree of removal of LOI was calculated using the following equation. LOI represents the amount of organic components (amount of residual resin) in casting sand.

Degree of removal of LOI (%)=(1−LOI (% by weight) in reclaimed sand/LOI (% by weight) in recovered sand)×100

(2) Evaluation of Mold Strength

A mold obtained by adding 1.0 part by weight of an alkali phenol resin (Kao Step S-660 manufactured by Kao-Quaker Co., Ltd.) and 0.25 part by weight of a hardening agent for alkali phenol resin (Kao Step KC-140 manufactured by Kao-Quaker Co., Ltd.) to 100 parts by weight of the resulting reclaimed casting sand or recovered sand was measured one day after mixing for its compressive strength under the conditions of 25° C. and 55% RH in accordance with JACT test method HM-1, with a strength testing machine AD-5000 manufactured by Shimadzu Corporation.

Comparative Example 1

Reclaimed sand was obtained in the same manner as in Example 1 except that dimethyl silicone oil was not added. Analytical values (LOI and LOI removal degree) of the reclaimed sand and the strength of a mold were measured in the same manner as in Example 1. The results are shown in Table 1.

Example 2

After 0.02 part by weight of dimethyl silicone oil (KF96-10CS manufactured by Shin-Etsu Chemical Co. Ltd.) was added to, and mixed with, 100 parts by weight of the reclaimed sand obtained in Comparative Example 1, 80 kg of the sand was introduced into a dry casting sand reclaiming apparatus (Hybrid Sand Master, type HSM1115, manufactured by Nippon Chuzo Co., Ltd.) provided with a fluidized bed as shown in FIG. 1, and then subjected to dry grinding treatment by batch treatment at a rotor rotation number of 2600 rpm for 30 min., to give reclaimed sand. When the dry grinding treatment was conducted, dust collection was carried out by floating releasable organic components from a fluidized bed. Analytical values (LOI and LOI removal degree) of the reclaimed sand and the strength of a mold were measured in the same manner as in Example 1. The results are shown in Table 1.

Comparative Example 2

Reclaimed sand was obtained in the same manner as in Example 2 except that dimethyl silicone oil was not added. Analytical values (LOI and LOI removal degree) of the reclaimed sand and the strength of a mold were measured in the same manner as in Example 1. The results are shown in Table 1.

Example 3

The recovered sand used in Example 1 was introduced at a sand feed rate of 2.7 t/hr into a high-speed rotation drum 2 such that 4 parts by weight of water was added to 100 parts by weight of the recovered sand (the amount of water in the recovered sand: 0.16% by weight) in a grinding apparatus capable of grinding treatment with water, having the structure shown in FIG. 2, followed by grinding treatment at a rotation number of 2542 rpm. The recovered sand was introduced toward the center of the high-speed rotation drum 2, and the corresponding water was also introduced toward the center of the high-speed rotation drum 2. The gap 6 between the upper circumference of the high-speed rotation drum 2 and the circular body 3 in this grinding apparatus was 5 mm, and the depth of the circular body 3 was 100 mm (see FIG. 3), and the retention time of the sand during grinding treatment was 26 seconds.

100 parts by weight of the resulting moistened sand was compounded with 0.04 part by weight of dimethyl silicone oil (KF96-10CS manufactured by Shin-Etsu Chemical Co. Ltd.) and then dried under stirring by blowing hot air at 150° C. in a concrete mixer. The amount of water in the recovered sand after drying was 0.06% by weight.

80 kg of the resulting dried sand was introduced into a dry casting sand reclaiming apparatus (Hybrid Sand Master, type HSM1115, manufactured by Nippon Chuzo Co., Ltd.) provided with a layer as shown in FIG. 1, and then subjected to dry grinding treatment by batch treatment at a rotor rotation number of 2600 rpm for 12 min., to give reclaimed sand. When the dry grinding treatment was conducted, dust collection was carried out by floating releasable organic components from a fluidized layer. Analytical values (LOI and LOI removal degree) of the reclaimed sand and the strength of a mold were measured in the same manner as in Example 1. The results are shown in Table 1.

The dimethyl silicone oil (KF96-10CS manufactured by Shin-Etsu Chemical Co. Ltd.) used in Examples 1 to 3 has a surface tension of 20 mN/m at 25° C., a viscosity at 25° C. of 10 $mm^2/s$ and a boiling point of 229° C. or more at 1 atmospheric pressure (recited in a catalogue of the manufacturer). The measurement of the surface tension is determined by an automatic surface tensiometer (Processor Tensiometer K100, manufactured by Krüss GmbH.

Figure 4:
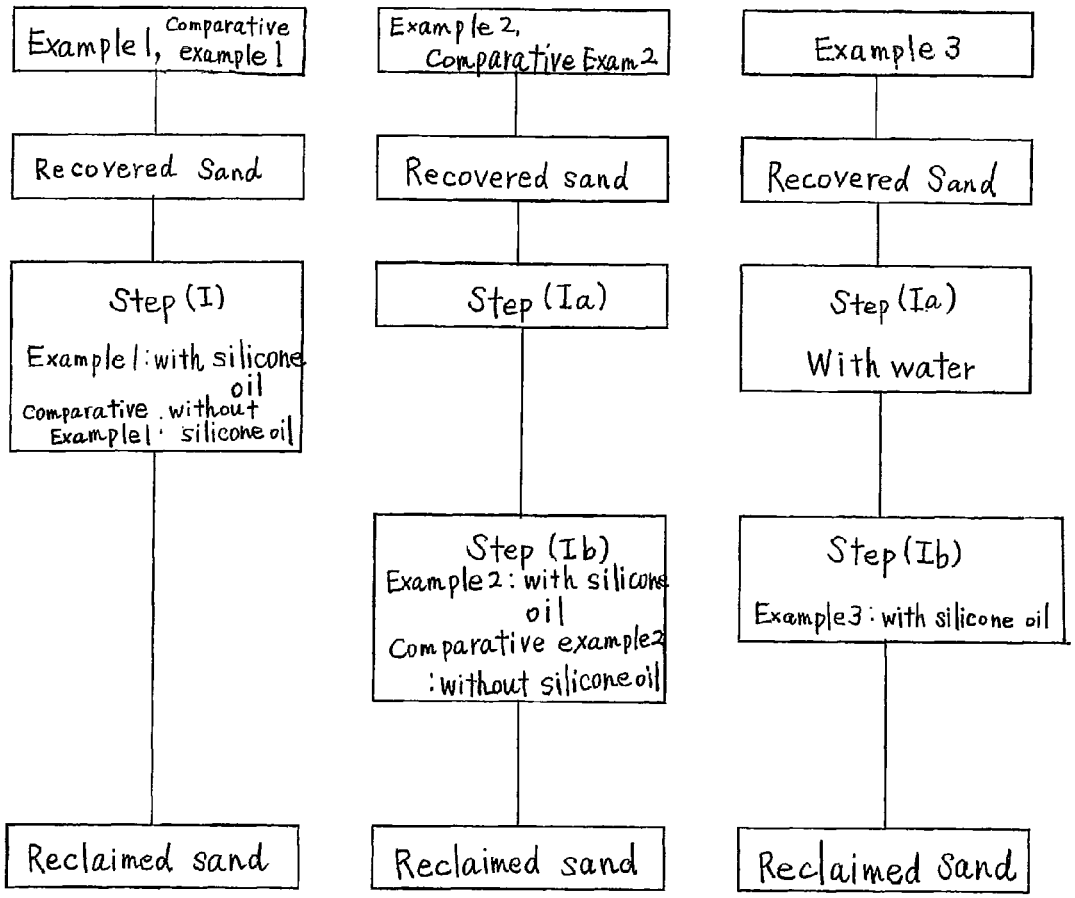
FIG. 4 is a flowchart showing procedures in the Examples and Comparative Examples, wherein 21 is the body of equipment; 22, a lower stirring tank; 23, an upper classification tank; 24, a blast room; 25, a blast opening; 26, a fluidized bed, and 220, recovered sand.

The procedures in Examples 1 to 3 and Comparative Examples 1 to 2 are shown in the flowchart in FIG. 4.

Table 1

TABLE 1

| | Grinding treatment method | | | Analytical values of sand | | |
|---|---|---|---|---|---|---|
| | Step (I) or step (Ia) | Step (Ib) | Addition of silicone oil | LOI (wt %) | LOI removal degree (%) | Mold strength (MPa) |
| Reference example | No treatment (recovered sand) | | | 0.47 | — | 1.27 |
| Example 1 | Step (I): mechanical grinding conducted 4 times | None | During the first machine grinding | 0.17 | 64 | 2.70 |
| Comparative example 1 | Step (I): mechanical grinding conducted 4 times | None | None | 0.24 | 49 | 2.43 |
| Example 2 | Step (Ia): mechanical grinding conducted 4 times | Step (Ib): mechanical grinding conducted once treatment time of 30 minutes | Step (Ib) | 0.09 | 81 | 3.00 |
| Comparative example 2 | Step (Ia): mechanical grinding conducted 4 times | Step (Ib): mechanical grinding conducted once treatment time of 30 minutes | None | 0.14 | 70 | 2.30 |
| Example 3 | Step (Ia): mechanical grinding conducted once with water | Step (Ib): mechanical grinding | Step (Ib) | 0.13 | 73 | 3.05 |

TABLE 1-continued

| Grinding treatment method | | | Analytical values of sand | | |
|---|---|---|---|---|---|
| Step (I) or step (Ia) | Step (Ib) | Addition of silicone oil | LOI (wt %) | LOI removal degree (%) | Mold strength (MPa) |
| treatment | conducted once treatment time of 12 minutes | | | | |

From the results in Table 1, it can be seen that in the Examples as compared with the Comparative Examples, residual organic components can be efficiently removed by adding the silicone oil, and a mold using the same can exhibit significant strength. Because casting sand is repeatedly used, the process for producing reclaimed casting sand according to the present invention can be repeatedly used to significantly reduce the saturated reclaimed sand LOI. This leads not only to the reduction in the amount of gas generated from a mold by reducing the LOI, but also to the reduction in the amount of added resin by improving mold strength so that gas defects can be significantly reduced, and is thus beneficial to the art. Further, the present invention, as compared with conventional reclamation technology, can reduce the frequency of reclamation treatment, thus significantly reducing electric power and significantly reducing facility costs.

In Example 1 and Comparative Example 2, residual organic components are larger in Example 1, however Example 1 is significantly superior in mold strength to Comparative Example 2.

Usually, mold strength is improved as residual organic components are decreased, however when recovered sand is ground for a long time or subjected to grinding too many times, there is a phenomenon that as shown by comparison between Comparative Examples 1 and 2, mold strength is decreased even if residual organic components are decreased. This is probably because residual organic components once released by grinding treatment are finely pulverized with sand and adhere again to the surface of the sand, and such adhering components have larger specific surface areas and are thus considered to exert a particularly harmful effect on hardening of a binder.

In the present invention, on the other hand, residual organic components are decreased and simultaneously mold strength is improved as shown in comparison between Examples 1 and 2. The reason for further improvement in mold strength by the present invention is not evident, and it is estimated that by the presence of silicone oil, residual organic components once released are prevented from adhering again to sand and are made easily removable with collected dust, so re-adhering residual organic components exerting a particular harmful influence on mold strength are reduced, thereby significantly improving mold strength.

It can be seen that by adding silicone oil to the sand after the step of grinding with water, residual organic components can be efficiently removed in reclamation treatment in a short time in Example 3 as compared with Example 2, and a mold using the resulting reclaimed sand can exhibit significant strength. It can also be seen that it is not necessary that dry grinding treatment is repeated many times, thus making it unnecessary to introduce multistage facilities as the facilities and making reclamation treatment feasible with simple facilities.

Examples 4 to 9 and Comparative Examples 3 to 5

0.30 part by weight of a hardening agent for alkali phenol resin (Kao Step KC-130 manufactured by Kao-Quaker Co., Ltd.) and 1.2 parts by weight of an alkali phenol resin (Kao Step S-660 manufactured by Kao-Quaker Co., Ltd.) were added to 100 parts by weight of the spherical artificial ceramic casting sand shown in Example 1. The mixture was stirred and formed into a mold having a sand/metal ratio of 4. A cast iron melt (FC200) at 1400° C. was poured into this mold and then cooled, and the mold was treated with a crusher to give recovered sand. This recovered sand was subjected twice to drying grinding treatment at a sand feed rate of 3.0 t/hr in an USR-type sand-reclaiming machine manufactured by Sintokogio, Ltd., to give reclaimed sand. This reclaimed sand was subjected once more to mold making and casting as described above, followed by cooled, and the mold was treated with a crusher to give recovered sand having an LOI of 0.79%. This recovered sand was subjected to sand reclamation under the same conditions as described above (sand feed rate was 3.0 t/hr, and dry grinding treatment was conducted twice) in the USR-type sand-reclaiming machine, to give reclaimed sand having an LOI of 0.53%, and this reclaimed sand was used as the sand for evaluation. 0.04 part by weight of various kinds of additives was mixed with 100 parts by weight of the reclaimed sand. Then, 80 kg of the resulting sand was introduced into a dry casting sand reclaiming apparatus (Hybrid Sand Master, type HSM1115, manufactured by Nippon Chuzo Co., Ltd.) and subjected to dry grinding treatment by batch treatment at a rotor rotation number of 2600 rpm for treatment times of 6 minutes, 12 minutes and 30 minutes respectively, to give reclaimed sand. When the dry grinding treatment was conducted, dust collection was carried out by floating releasable organic components from a fluidized layer. Analytical values (LOI) of the reclaimed sand in each of the treatment times and the strength of a mold were measured in the same manner as in Example 1. The results are shown in Table 2.

The procedures after the second casting in Examples 4 to 9 and Comparative Examples 3 to 5 correspond to the flowchart in Example 2 and Comparative Example 2 shown in FIG. 4, and the recovered sand was the one after the second casting and various additives were used in place of the silicone oil.

Comparative Example 6

Reclaimed sand was obtained in the same manner as in Example 4 except that the silicone oil was added at the time of second mold making however was not added before treatment with Hybrid Sand Master. Analytical values (LOI) of the reclaimed sand in each of the treatment times and the strength of a mold were measured in the same manner as in Example 1. The results are shown in Table 2.

The dimethyl silicone oil used in Examples 4 to 9 and Comparative Examples 3 to 6 was KF-96-30CS manufactured by Shin-Etsu Chemical Co. Ltd. The used ethyl silicate condensate was Ethyl Silicate 40 manufactured by Colcoat. Co., Ltd. The used polyoxyethylene lauryl ether (the average number of added EO moles is 2) was Emulgen 102KG. Oleyl alcohol, 1-octanol, 1,4-butanediol, 1-butanol and oleic acid were reagents manufactured by Wako Pure Chemical Industries, Ltd. Physical properties thereof are shown in Table 2. The boiling points of the additives used in Example 4, 7 and Comparative Example 6 are values disclosed in a catalogue published by the manufacturer.

Table 2

TABLE 2

| | | Additives | Physical properties of additives: Surface tension at 25° C. (mN/m) | Viscosity at 25° C. (mm2/s) | Boiling point (° C.) | LOI (wt %): Treatment for 6 min. | Treatment for 12 min. | Treatment for 30 min. | Mold strength (MPa): Treatment for 12 min. | Treatment for 30 min. |
|---|---|---|---|---|---|---|---|---|---|---|
| Example | 4 | dimethyl silicone oil KF-96-30CS | 21 | 30 | 229 or more | 0.34 | 0.26 | 0.18 | 2.66 | 2.91 |
| | 5 | Oleyl alcohol | 32 | 29 | 340 | 0.38 | 0.25 | 0.18 | 2.76 | 2.91 |
| | 6 | 1-octanol | 27 | 7 | 195 | 0.37 | 0.28 | 0.23 | 2.20 | 2.60 |
| | 7 | Ethyl silicate 40, ethyl silicate condensate | 27 | 3 | 165 or more | 0.34 | 0.26 | 0.23 | 2.24 | 2.63 |
| | 8 | Oleic acid | 33 | 28 | 360 | 0.38 | 0.32 | 0.22 | 2.20 | 2.50 |
| | 9 | Polyoxyethylene lauryl ether (average number of EO moles added per molecule: 2) | 30 | 17 | 260 | 0.36 | 0.29 | 0.23 | 2.44 | 2.78 |
| Comparative example | 3 | None | — | — | — | 0.44 | 0.35 | 0.27 | 1.54 | 1.84 |
| | 4 | 1,4-butanediol | 45 | 72 | 229 | 0.40 | 0.33 | 0.23 | 1.86 | 2.30 |
| | 5 | 1-butanol | 25 | 3 | 118 | 0.39 | 0.33 | 0.23 | 2.10 | 2.40 |
| | 6 | Dimethyl silicone oil KF-96-30CS added during mold making | 21 | 30 | 229 or more | 0.46 | 0.34 | 0.25 | 1.47 | 1.84 |

In each of the Examples, LOI is reduced by grinding treatment in a short time (Hybrid Sand Master), and a mold using the resulting reclaimed sand is improved.

When the additive was added during mold molding, the effect of reducing LOI during sand reclamation and the effect of improving mold strength were not observed. These effects were not attained, probably because the additive was decomposed by heating upon casting, etc.

The invention claimed is:

1. A process for producing reclaimed casting sand, which comprises the steps of:

disassembling a mold comprising a sand and an organic binder so as to obtain a recovered sand;

adding an additive (A) to the recovered sand; and grinding the recovered sand in the presence of the additive (A) comprising a liquid having a surface tension of not higher than 35 mNm at 25° C. and a boiling point of not lower than 150° C. at 1 atmospheric pressure, wherein the amount of the additive (A) during grinding treatment is 0.001 to 0.2 part by weight based on 100 parts by weight of the recovered sand, and the additive (A) is added at the time of the grinding treatment.

2. The process for producing reclaimed casting sand according to claim 1, wherein the additive (A) is at least one member selected from the group consisting a silicone oil, an alcohol having 8 to 18 carbon atoms, a carboxylic acid having 8 to 18 carbon atoms, an alkyl silicate having an alkyl group having 1 to 8 carbon atoms and lower condensates thereof, and a polyoxyalkylene alkyl ether having an alkyl group having 8 to 18 carbon atoms.

3. The process for producing reclaimed casting sand according to claim 1 or 2, wherein the additive (A) is added in the grinding treatment.

4. The process for producing reclaimed casting sand according to claim 1 or 2, wherein the recovered sand is recovered sand from a mold using a water-soluble phenol resin as a binder.

5. The process for producing reclaimed casting sand according to claim 1 or 2, wherein the recovered sand is recovered sand from a mold using artificial ceramic sand as casting sand.

6. The process for producing reclaimed casting sand according to claim 1 or 2, in which the grinding treatment is carried out by adding 0.5 to 20 parts by weight of water to 100 parts by weight of the recovered sand.

7. The process for producing reclaimed casting sand according to claim 1, wherein residual organic components are removed out from the recovered sand.

8. A process for producing reclaimed casting sand, which comprises the steps of:

first, disassembling a mold comprising a sand and an organic binder so as to obtain a recovered sand;

second, adding an additive (A) to the recovered sand; and third, grinding the recovered sand in the presence of the additive (A) comprising a liquid having a surface tension of not higher than 35 mNm at 25° C. and a boiling point of not lower than 150° C. at 1 atmospheric pressure, wherein the amount of the additive (A) during grinding treatment is 0.001 to 0.2 part by weight based on 100 parts by weight of the recovered sand.

* * * * *